US005798082A

United States Patent [19]

Kadoya et al.

[11] Patent Number: 5,798,082

[45] Date of Patent: Aug. 25, 1998

[54] HIGH-STRENGTH AND HIGH-TOUGHNESS HEAT-RESISTANT CAST STEEL

[75] Inventors: Yoshikuni Kadoya; Hisataka Kawai; Ryotarou Magoshi, all of Hyogo-ken, Japan

[73] Assignee: Mitsubishi Heavy Industries, Ltd., Tokyo, Japan

[21] Appl. No.: 846,171

[22] Filed: Apr. 28, 1997

[30] Foreign Application Priority Data

Sep. 10, 1996 [JP] Japan ..... 8-239022

[51] Int. Cl.[6] ..... C22C 38/44; C22C 38/46

[52] U.S. Cl. ..... 420/38; 148/325; 148/326

[58] Field of Search ..... 148/326, 325; 420/38

[56] References Cited

U.S. PATENT DOCUMENTS 5,650,024 7/1997 Hasegawa et al. ..... 148/326

FOREIGN PATENT DOCUMENTS 7-70713 3/1995 Japan .

OTHER PUBLICATIONS

Key To Steels, 10 Edition 1974, Germany, Oct. 1974.

*Primary Examiner*—Deborah Yee
*Attorney, Agent, or Firm*—Foley & Lardner

[57] ABSTRACT

There are provided high-strength and high-toughness heat-resistant cast steels applicable to steam turbine casings, precision cast vanes and valves. There is disclosed a high-strength and high-toughness heat-resistant cast steel formed of a heat-resistant cast steel consisting of, based on weight percentage: 0.08 to 0.25% of carbon; more than 0.1 not more than 0.5% of silicon; 1% or less of manganese; 0.05 to 1% of nickel; 9 to 12% of chromium; 0.3 to 1.5% of molybdenum; 1 to 1.95% of tungsten; 0.1 to 0.35% of vanadium; 0.02 to 0.1% of niobium; 0.01 to 0.08% of nitrogen; 0.001 to 0.01% of boron; and 2 to 8% of cobalt; the balance substantially being iron; and having a martensite matrix structure.

15 Claims, 2 Drawing Sheets

TYPE OF WHOLE METALLOGRAPHIC STRUCTURE

TEMPERED MARTENSITE STRUCTURE

| POSITION / DIVISION | INTERIOR OF MARTENSITE LATHS | MARTENSITE LATH BOUNDARY | GRAIN BOUNDARY (FORMER AUSTENITE GRAIN BOUNDARY) |
|---|---|---|---|
| FORMS OF PRECIPITATES | FINE PRECIPITATES | AGGLOMERATED GRANULAR PRECIPITATES | AGGLOMERATED GRANULAR PRECIPITATES |
| AS-TEMPERED STATE AFTER HEAT-TREATMENT | ·MX TYPE CARBONITRIDES | ·$M_{23}C_6$ TYPE CARBIDES ·INTERMETALLIC COMPOUNDS (LAVES PHASES) | ·$M_{23}C_6$ TYPE CARBIDES ·INTERMETALLIC COMPOUNDS (LAVES PHASES) |
| AFTER CREEP RUPTURE | ·MX TYPE CARBONITRIDES | ·$M_{23}C_6$ TYPE CARBIDES ·INTERMETALLIC COMPOUNDS (LAVES PHASES) | ·$M_{23}C_6$ TYPE CARBIDES ·INTERMETALLIC COMPOUNDS (LAVES PHASES) |

FIG. 2

TYPE OF WHOLE METALLOGRAPHIC STRUCTURE:

TEMPERED MARTENSITE STRUCTURE

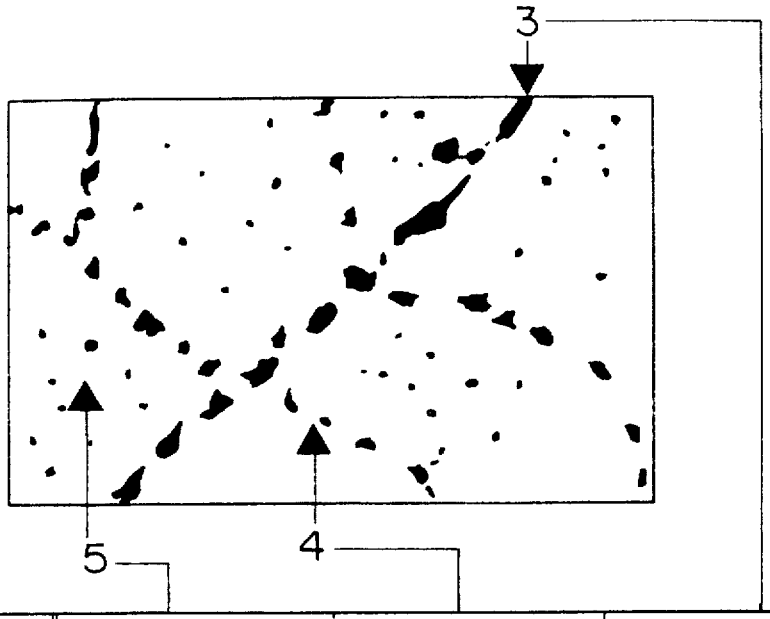

| POSITION / DIVISION | INTERIOR OF MARTENSITE LATHS | MARTENSITE LATH BOUNDARY | GRAIN BOUNDARY (FORMER AUSTENITE GRAIN BOUNDARY) |
|---|---|---|---|
| FORMS OF PRECIPITATES | FINE PRECIPITATES | AGGLOMERATED GRANULAR PRECIPITATES | AGGLOMERATED GRANULAR PRECIPITATES |
| AS-TEMPERED STATE AFTER HEAT-TREATMENT | ·MX TYPE CARBONITRIDES | ·$M_{23}C_6$ TYPE CARBIDES ·INTERMETALLIC COMPOUNDS (LAVES PHASES) | ·$M_{23}C_6$ TYPE CARBIDES ·INTERMETALLIC COMPOUNDS (LAVES PHASES) |
| AFTER CREEP RUPTURE | ·MX TYPE CARBONITRIDES | ·$M_{23}C_6$ TYPE CARBIDES ·INTERMETALLIC COMPOUNDS (LAVES PHASES) | ·$M_{23}C_6$ TYPE CARBIDES ·INTERMETALLIC COMPOUNDS (LAVES PHASES) |

HIGH-STRENGTH AND HIGH-TOUGHNESS HEAT-RESISTANT CAST STEEL

BACKGROUND OF THE INVENTION

1. Field of the Invention

The present invention generally relates to heat-resistant cast steels for cast steel members suitable for use in applications such as steam turbine casings, precision cast vanes and valves.

Particularly, the present invention relates to high-strength and high toughness heat-resistant cast steels which are suitable for steam turbine casings to be used at a steam temperature of 593° C. or higher, and are applicable to steam turbine casings, precision cast vanes and valves having excellent creep rupture strength at a temperature in the range of 550° to 650° C., as well as possessing excellent toughness at ambient temperature.

2. Description of Related Art

Recently, it has been desired to operate thermal electric power plants at higher temperatures and under higher pressures for improving efficiency. The highest steam temperature for steam turbines is presently 593° C., but steam temperatures of 600° C., and ultimately up to 650° C. are planned for future thermal electric power plants.

In order to adopt higher steam temperatures, heat-resistant materials having high-temperature strengths greater than those of conventional ferritic heat-resistant steels are generally required. One suitable heat-resistant material is conventional austenitic heat-resistant alloys, because some austenitic alloys have excellent heat-resistant strength. However, these alloys are not really practical, since, for example, they have low thermal fatigue strength due to their large coefficients of thermal expansion. In addition, austenitic alloys are generally expensive.

Cast steel members such as casings, flanges and valves for steam turbines are also used under the above noted ultrahigh critical pressures. Therefore, such cast steel members are generally required to have excellent high-temperature characteristics so that they can endure severe operational conditions. Such cast steel members also should possess excellent toughness sufficient for reducing deterioration over years.

For the casings of the conventional large-sized steam turbines, cast steels such as "Cr-Mo" and "Cr-Mo-V", as well as "12Cr-Mo" and "12Cr-Mo-V" and the like have been proposed. "Cr-Mo" and "Cr-Mo-V" cast steels are generally not suited as high-temperature casings to be used under the above desired conditions and steam temperature, since these steels generally have low values of high-temperature strengths and are difficult to be produced with their characteristics in a stable manner. As such, "Cr-Mo" and "Cr-Mo-V" cast steels will tend to go beyond their usage limits. Further, although "12Cr-Mo" and "12Cr-Mo-V" cast steels have high-temperature strengths greater than "Cr-Mo" and "Cr-Mo-V" cast steels, they also tend to go beyond their usage limits since their long-time creep rupture strength deteriorates at a steam temperature of 593° C. or higher.

There have been recently proposed new heat-resistant cast steels having high creep rupture strength at high temperatures and excellent weldability. For example, Japanese Patent Application Provisional Publication No.7-70713, discloses cast steels having good elongation toughness and high-temperature strengths. The prior cast steels discussed therein are claimed to include Si in an amount of 0.2% or less, but they actually have values of as low as 0.05 to 0.08% as shown in Table 2 thereof.

The aforementioned cast steels such as "12Cr-Mo" and "12Cr-Mo-V" do not have satisfactory elongation toughness and high-temperature strengths under the severe conditions identified above. Thus, it has been strongly desired to develop 12Cr series of heat-resistant steels having improved characteristics.

SUMMARY OF THE INVENTION

In view of the above, it was therefore a first object of the present invention to provide a heat-resistant cast steel, suitable for use in steel members such as casings, exhibiting excellent long-time creep rupture strength, notch creep rupture strength, creep rupture ductility and toughness even under severe conditions including steam temperatures of 593° C. or more.

It is a second object of the present invention to provide heat-resistant cast steel, for steel members such as casings, exhibiting not only excellent strengths at high temperatures, but also excellent toughness at ambient temperature. This is because brittle fracture may occur in a steam turbine used for thermal electric power generation when rotation of the turbine is started, if the toughness of the turbine is low at ambient temperature.

It is a third object of the present invention to provide a heat-resistant cast steel, suitable for use in steel members such as casings, exhibiting high ductility for avoiding cracks due to thermal fatigue. When the turbine is repeatedly started and stopped so frequently in response to variation in electric power demand over the daytime and nighttime, cracks due to thermal fatigue may occur due to thermal stresses. Such cracks after often caused by rapid cooling of casing surfaces alone when the operation is being stopped. To avoid such cracks, it is desirable for heat-resistant cast steels used as steel members such as casings to have high ductility.

In accordance with these and other objects, there is provided a heat-resistant cast steel having a martensite matrix, wherein the cast steel consists essentially of, based on weight percentage: 0.08 to 0.25% carbon; more than 0.1% and up to 0.5% silicon; not more than 1.0% manganese; 0.05 to 1.0% nickel; 9 to 12% chromium; 0.3 to 1.5% molybdenum; 1.0 to 1.95% tungsten; 0.1 to 0.35% vanadium; 0.02 to 0.1% niobium; 0.01 to 0.08% nitrogen; 0.001 to 0.01% boron; 2 to 8% cobalt; and the balance substantially iron.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 2 is an exemplary view showing characteristics of metallographic structure according to the third example of the present invention.

DETAILED DESCRIPTION

Figure 1:
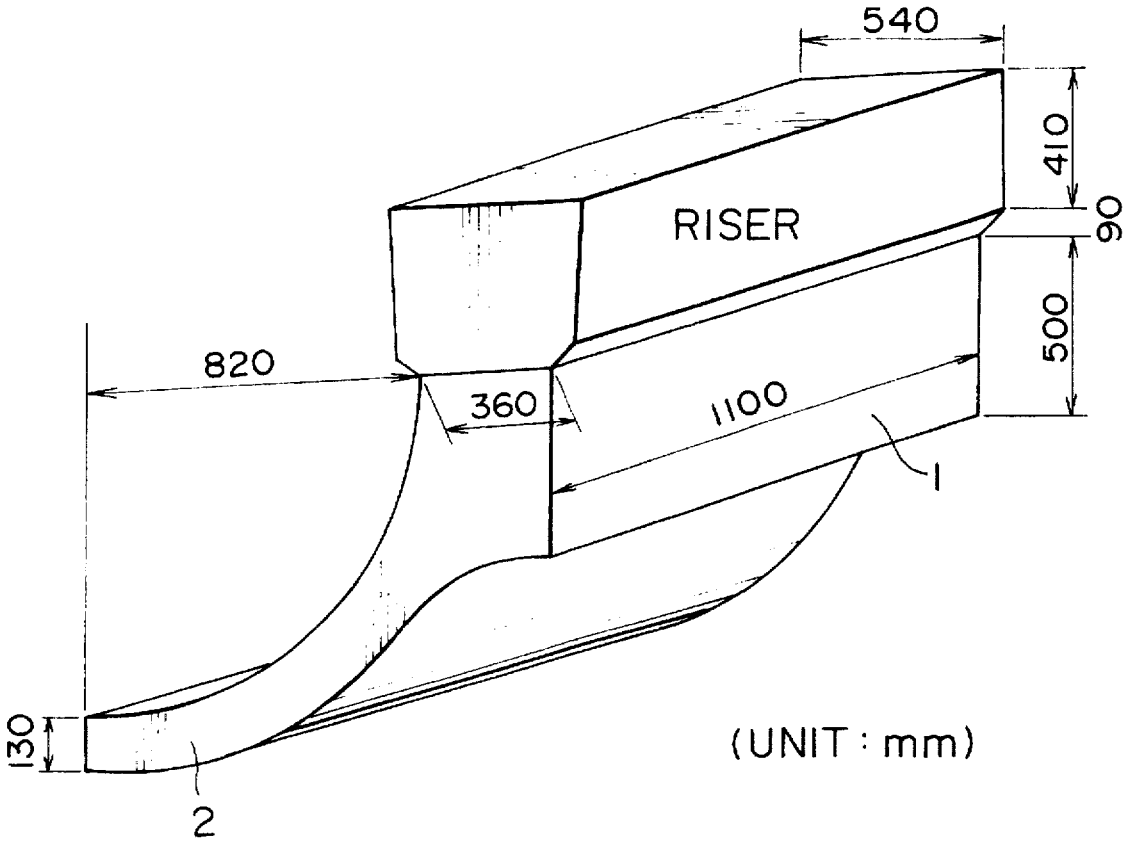
FIG. 1 is a schematic view showing a casting shape for test specimens according to the second example of the present invention.

In accordance with the present invention, contrary to Si levels taught in the prior art, the amount of Si is preferably less than 0.5% in steels according to the present invention so as to improve melt flowability in casting to thereby obtain manufacturing leeway, and most preferably about 0.2% Si is practical in fact.

Further, in accordance with the present invention, there are provided cast steels containing B(boron) as a base steel, whereas no boron is generally added into the conventional cast steels discussed above. Thus, the present invention has attached importance to castability for complicated shapes of parts such as casings, as compared to the conventional cast steels which have material characteristics different from those of the present invention, in that conventional cast steels do not include Boron.

The present inventors have reviewed the conventional heat-resistant cast steels to investigate optimum amounts of various elements for attaining higher strengths. As a result, it has been newly discovered in connection with the present invention, that Co is preferably positively included in an amount greater than what is conventionally employed so as to stabilize the martensite structure and to increase resistance to temper softening. It is also preferable that both Mo and W are added with the amount of W preferably being greater than that of Mo. In this regard, an added Mo equivalent (Mo+0.5W) preferably has a value larger than that described in the prior art so as to improve high-temperature strength. High-temperature strength is further improved by virtue of the cooperative effect of the Mo equivalent and Co.

Thus, a first high-strength and high-toughness heat-resistant cast steel according to the present invention has a structure of a martensite matrix, and consists essentially of, based on weight percentage: 0.08 to 0.25% carbon; more than 0.1% and up to 0.5% silicon; not more than 1.0% manganese; 0.05 to 1.0% nickel; 9 to 12% chromium; 0.3 to 1.5% molybdenum; 1.0 to 1.95% tungsten; 0.1 to 0.35% vanadium; 0.02 to 0.1% niobium; 0.01 to 0.08% nitrogen; 0.001 to 0.01% boron; 2 to 8% cobalt; and iron.

A second high-strength and high-toughness heat-resistant cast steel according to the present invention comprises a heat-resistant cast steel having a structure of a martensite matrix and the steel consisting of, based on weight percentage: 0.08 to 0.25% carbon; more than 0.1% and up to 0.5% silicon; not more than 1% manganese; 0.05 to 1% nickel; 9 to 12% chromium; 0.3 to 1.5% molybdenum; 1.0 to 1.95% tungsten; 0.1 to 0.35% vanadium; 0.02 to 0.1% niobium; 0.01 to 0.08% nitrogen; 0.001 to 0.01% boron; 2 to 8% cobalt; and iron; and wherein a Cr equivalent is defined by (Cr+6Si+4Mo+1.5W+11V+5Nb−40C−2Mn−4Ni−2Co−30N) is 6.5% or less; a B equivalent is defined by (B+0.5N) is 0.03% or less; a Nb equivalent is defined by (Nb+0.4C) is 0.12% or less; a Mo equivalent is defined by (Mo+0.5W) is 1 to 2%; and among unavoidable impurity elements, sulfur is limited to 0.01% or less, phosphorus is limited to 0.03% or less, and copper is limited to 0.5% or less.

A third high-strength and high-toughness heat-resistant cast steel according to the present invention is the first or second heat-resistant cast steel, in which the same is treated by subjecting the heat-resistant cast steel to a melting and quenching heat treatment at a temperature in the range of 1,000° to 1,150° C. After the heating treatment, the steel is subjected to a first-step of tempering at a temperature of at least 650° to 730° C., and thereafter to a second-step of tempering at a higher temperature of 700° to 750° C. which acts as annealing step for stress removal.

A fourth high-strength and high-toughness heat-resistant cast steel according to the present invention is the above described third heat-resistant cast steel, wherein the same is formed of the heat-resistant cast steel in which $M_{23}C_6$ type carbides and intermetallic compounds are precipitated mainly at grain boundaries and martensite lath boundaries, and MX type carbonitrides are precipitated internally of martensite laths, so that the steel contains these precipitates.

Further, the fifth high-strength and high-toughness heat-resistant cast steel according to the present invention is the above described fourth heat-resistant cast steel in which the steel forming the heat-resistant cast steel is produced by a melting and ladle-refining method.

Those heat-resistant cast steels having martensite structure having the chemical composition range according to the present invention generally have remarkably improved creep rupture strength and fully satisfy the designed stresses, as compared to the conventional heat-resistant steels such as those comparative steels Nos. 7 and 8 shown in Table 1 to be explained later herein with reference to the Example 1. Further, the steels according to the present invention generally exhibit excellent structural stability even when the same are used at high temperatures for a long period of time. Namely, the basic steel of the present invention includes B, while Co is added thereto in an amount of as much as 2 to 8%, leading to strengthening of solid solution by virtue of the addition of B. The use of Co further stabilizes the martensite structure and increases the temper softening resistance. Moreover, while Mo and W are concurrently added into the steel for improving high-temperature strength, the substantially large amount of Co helps sufficient solid solution formation of Mo and W and aids in structural stability during long-time service. Still further, the added Mo equivalent (Mo+0.5W) amount is generally somewhat larger than in conventional steels, so that the high-strength and high-toughness heat-resistant cast steels according to the present invention generally have superior room-temperature strength, high-temperature strength and toughness, as well as reliability, than conventional steels. Yet further, according to the present invention, there can be obtained steel members such as casings suited for a larger-sized high-temperature steam turbine. Thus, the present steels remarkably improve the efficiency of thermal power generation, for example, by exhibiting higher reliability over a long period of time even under ultrahigh and/or critical steam conditions.

There will be described hereinafter exemplary reasons why the composition and the amounts of elements for the high-strength and high-toughness heat-resistant cast steels according to the present invention were determined. The description is based on weight percentage.

Carbon(C): C serves to secure hardenability. During the tempering process, it combines with Cr, Mo, W and the like to form $M_{23}C_6$ type carbides at grain boundaries and martensite lath boundaries, and combines with Nb, V and the like to form MX type cabonitrides within martensite laths. High-temperature strength can be improved as a result of strengthening by precipitation of the aforesaid $M_{23}C_6$ type carbides and Mx type carbonitrides. In addition to the securing of yield strength or proof stress and toughness, C is an indispensable element required to inhibit the formation of δ-ferrite and BN. In order to achieve the yield strength and toughness required for the casing material of the heat-resistant cast steels according to the present invention, C should preferably be present in an amount of 0.08% or greater. However, unnecessarily large amounts of C may cause a reduction in toughness and induces excessive precipitation of $M_{23}C_6$ type carbides which reduces the strength of the matrix, thereby deteriorating high-temperature strength long term. Accordingly, the content of C is preferably within the range of 0.08 to 0.25%, and more preferably from 0.09 to 0.13%.

Silicon (Si): Si is an effective element as a deoxidizer for molten steel. However, the addition of Si in large amounts may cause the by-product $SiO_2$ to be present in the steel, deteriorating the cleanliness of the steel and reducing the toughness thereof. Moreover, Si promotes the formation of the Laves phases($Fe_2M$) which are intermetallic compounds, causes a reduction in creep rupture ductility due to intergranular segregation or the like, and promotes temper embrittlement during high-temperature services. Thus, the amount of Si content is preferably limited to a small value. Nonetheless, the content of Si should preferably be more than 0.1% and up to 0.5%, since an extremely lowered upper limit thereof may not be practical due to the less manufacture leeway by the less improvement of melt flowability in casting.

Manganese (Mn): Mn is an element effective for use as a deoxidizing and desulfurizing agent for molten steel, and for increasing hardenability to thereby improve strength. Moreover, Mn is effective for inhibiting the formation of δ-ferrite and BN to thereby promote the precipitation of $M_{23}C_6$ type carbides. However, Mn progressively reduces creep rupture strength as the content thereof increases, so that the content of Mn should be preferably limited to at most 1%, most preferably 0.2 to 0.5%.

Nickel (Ni): Ni is an effective element which increases the hardenability of steel, inhibits the formation of δ-ferrite and BN, and improves strength and toughness at room temperature, so that a content of preferably at least 0.05% is desirable. Ni is particularly effective in the improvement of toughness. Moreover, when the content of both Ni and Cr are high, these effects are remarkably enhanced because of their synergistic action. However, if the content of Ni exceeds 1%, the high-temperature strength (creep strength and creep rupture strength) may be deteriorated while unduly promoting temper embrittlement. Accordingly, the content of Ni is determined to preferably be within the range of 0.05 to 1%, most preferably 0.05 to 0.5%.

Chromium (Cr): Cr is highly desirable for use as a constituent element of $M_{23}C_6$ type carbides which provide oxidation resistance and corrosion resistance and contribute to high-temperature strengths owing to precipitation and dispersion strengthening. In order to achieve these effects, preferably at least 9% of Cr content is desirable in the steels of the present invention. However, if its content exceeds 12%, δ-ferrite may be formed and high-temperature strength and toughness may accordingly be reduced. As such, the content of Cr should preferably be within the range of 9 to 12%, most preferably 9.5 to 10.5%. Moreover, in the manufacture of heat-resistant cast steels for steel members such as casings, it is desirable to prevent the precipitation of δ-ferrite during solution heat treatment. In the steels of the present invention, therefore, the Cr equivalent (Cr+6Si+4Mo+1.5W+11V+5Nb−40C−2Mn−4Ni−2Co−30N) is preferably 6.5% or less. Thus, the formation of δ-ferrite can substantially be avoided.

Molybdenum (Mo): Similarly to Cr, Mo is an element which is important for use as an additional element of ferritic steel. The addition of Mo to steel is generally effective in increasing hardenability, increasing resistance to temper softening during tempering, and thereby improving the ordinary or ambient temperature strength (tensile strength and yield strength), and high-temperature strength. Moreover, Mo acts as a solid solution strengthening element and functions to promote the fine precipitation of $M_{23}C_6$ type carbides while preventing the aggregation thereof. Owing to the formation of other carbides, Mo also acts as a precipitation strengthening element which is generally very effective in improving high-temperature strength such as creep strength and creep rupture strength. Furthermore, Mo is a very effective element which, when added preferably in an amount of about 0.3% or greater, can substantially prevent the temper embrittlement of steel. However, the excessive addition of Mo tends to induce the formation of δ-ferrite and thereby causes a violent reduction in toughness. Moreover, excessive Mo may lead to the unexpected precipitation of Laves phases($Fe_2M$) which are intermetallic compounds. Nonetheless, in the steels of the present invention, these tendencies of Mo are generally restrained by virtue of coexistence with Co. Accordingly, the upper limit of the content of Mo can be increased to 1.5%. Thus, the content of Mo can be determined to be preferably within the range of 0.3 to 1.5%.

Tungsten (W): W is generally more effective than Mo in inhibiting the aggregation and coarsening of $M_{23}C_6$ type carbides. Moreover, W acts as a solid solution strengthening element which is generally effective in improving high-temperature strength, such as creep strength and creep rupture strength. This effect is more remarkable when W is added in combination with Mo. However, if W is added in large amounts, it tends to form δ-ferrite and Laves phases ($Fe_2M$) which are intermetallic compounds, typically resulting in a reduction in ductility and toughness, as well as creep rupture strength. Furthermore, the content of W is affected not only by the content of Mo, but also by that of Co as will be discussed later. When the content of Co is within the preferable range of 2 to 8%, the addition of more than 2% of W may induce undesirable phenomena such as solidification segregation in large-sized forged products. In view of the above, the content of W is determined to preferably be within the range of 1 to 1.95%. The effects produced by the addition of W are more remarkable when W is added in combination with Mo. Their amount added (i.e., Mo+0.5W) is preferably within the range of 1 to 2%. This (Mo+0.5W) is defined as the Mo equivalent.

Vanadium (V): Similarly to Mo, V is an element which is effective in the improvement of strength (tensile strength and yield strength) at ordinary or ambient temperature. Moreover, V forms a fine carbonitride within martensite laths, while acting as a solid solution strengthening elements. This fine carbonitride assists in controlling the recovery of dislocations occurring during creep, and thereby increases high-temperature strength such as creep strength and creep rupture strength. Consequently, V is important as a precipitation strengthening element. If the amount of added V is within a preferred range (0.03 to 0.35%), the same is also effective in making crystal grains finer, thereby improving toughness. However, if V is added in unduly large amounts, it not only deteriorates toughness, but also tends to fix carbon to an excessive extent and decreases the precipitation of $M_{23}C_6$ type carbides, thus reducing high-temperature strength. Accordingly, the content of V is determined to preferably be within the range of 0.1 to 0.35%, most preferably 0.15 to 0.25%.

Niobium (Nb): Similarly to V, Nb is an element which is effective in increasing ordinary-temperature strength such as tensile strength and yield strength, and high-temperature strength such as creep strength and creep rupture strength. At the same time, Nb is also an element which is very effective in improving toughness by forming fine NbC and making crystal grains finer. Moreover, some Nb passes into solid solution during hardening and precipitates during tempering processes in the form of a MX type carbonitride combined with the above-described carbonitride of V, thereby improving high-temperature strength. Thus, the addition of at least 0.02% of Nb is desirable. However, when the addition of Nb exceeds 0.1%, it tends to fix carbon to an excessive degree and decreases the precipitation of $M_{23}C_6$ type carbides to reduce high-temperature strength. Therefore, the content of Nb is preferably within the range of 0.02% to 0.1%, most preferably 0.02 to 0.05%. In the manufacture of large-sized casings, agglomerated NbC may crystallize out during the solidification of a steel ingot. This agglomerated NbC may exert an adverse effect on mechanical properties. Accordingly, the sum of Nb and 0.4 times C is preferably 0.12% or less (i.e., $Nb+0.4C \leqq 0.12\%$). Thus, the crystallization of agglomerated NbC can substantially be avoided. (Nb+0.4C) is defined as the Nb equivalent.

Boron (B): Owing to the effect of strengthening grain boundaries and the effect of preventing the aggregation and coarsening of $M_{23}C_6$ type carbides by passing into solid solution thereof, B is generally effective in the improvement of high-temperature strength. Although the addition of at least 0.001% of B is generally effective, more than 0.01% of B may be detrimental to weldability and the like. Accordingly, the content of B is preferably within the range of 0.001 to 0.01%, most preferably 0.003 to 0.008%. The sum of B and 0.5 times N is preferably 0.03% or less (i.e., $B+0.5N \leqq 0.03\%$). Thus, the reduction of weldability can substantially be avoided. This (B+0.5N) is defined as the B equivalent.

Nitrogen (N): N functions to improve high-temperature strength by precipitating a nitride of V and, in cooperation with Mo and W, produces an IS effect (i.e., the interaction of interstitial solid solution element and a substitutional solid solution element) in its solid solution state. Thus, a content of at least 0.01% is desirable for N. However, since more than 0.08% of N tends to cause a reduction in ductility, the content of N is preferably within the range of 0.01 to 0.08%, most preferably 0.02 to 0.04%. Moreover, in the coexistence of N with B as described above, N may promote the formation of BN. Accordingly, it is preferable as described above, that the B equivalent (B+0.5N) be 0.03% or less.

Cobalt (Co): Co is an important element which, inter alia, distinguishes the present invention from the prior art. Co contributes to solid solution strengthening and has the effect of inhibiting the precipitation of δ-ferrite. Thus, Co is useful in the manufacture of large-sized forged products. In the present invention, the addition of Co makes it possible to add alloying elements substantially without altering the $A_{c1}$ transformation point (about 780° C.) resulting in a remarkable improvement of high-temperature strength. This may be due to an interaction of Co with Mo and W, and may be a distinctive phenomenon of the steels of the present invention in which the Mo equivalent (Mo+0.5W) is 1 or greater. In order to achieve these effects of Co, the lower limit of the Co content in the steels of the present invention should most preferably be about 2%. On the other hand, since the addition of excess Co results in a reduction in ductility and an increase in cost, its upper limit is preferably about 8%. Accordingly, the content of Co should preferably be within the range of 2 to 8%, most preferably 3 to 4%. Moreover, in the manufacture of large-sized casings, it is desirable to inhibit the precipitation of δ-ferrite during solution heat treatment. Co is an element which is effective in reducing the Cr equivalent (Cr+6Si+4Mo+1.5W+11V+5Nb−40C−2Mn−4Ni−2Co−30N) serving as a parameter for predicting the precipitation of δ-ferrite. In the steels of the present invention, the Cr equivalent is preferably 6.5% or less. Thus, the formation of δ-ferrite can substantially be avoided.

Others: P, S, Cu and the like are unavoidable impurity elements originating from the raw materials used for steel making, and it is desirable that their contents be as low as possible. However, since an overstrict selection of raw materials leads to an increase in cost, it is desirable that the content of P be not greater than 0.03% and preferably 0.015%, that S preferably not be greater than 0.01% and most preferably 0.005%, and that Cu preferably not be greater than 0.5%. Other impurity elements may include, for example, Al, Sn, Sb, As, and the like.

The temperature employed for a suitable solution and hardening heat treatment is explained hereinafter. In the heat-resistant steels of the present invention, 0.02 to 0.1% of Nb is preferably added because Nb is generally effective in precipitating an MX type carbonitride and thereby improving high-temperature strength. In order to achieve this effect, it is desirable to bring Nb completely into solid solution in austenite during solution heat treatment. However, if the quenching temperature is lower than 1,000° C., the coarse carbonitride precipitated during solidification may remain, even after the heat treatment. Then, Nb does not function quite effectively to increase creep rupture strength. In order to bring this coarse carbonitride once into solid solution and thereafter precipitate it densely as a fine carbonitride, it is desirable to quench the steel at an austenitizing temperature of preferably about 1,000° C. or higher at which austenitization proceeds further. On the other hand, if the quenching temperature exceeds about 1,150° C., a temperature region enters where δ-ferrite may be precipitated in the heat-resistant cast steels of the present invention, possibly resulting in a reduction in toughness. Accordingly, it is preferable that the quenching temperature be within the range of 1,000° C. to 1,150° C.

A temperature employed for a suitable tempering treatment is explained hereinafter. The heat-resistant cast steels of the present invention are characterized in that, in order to substantially completely remove the austenite remaining after quenching, a first-step tempering heat treatment is preferably conducted at a temperature of 650° to 730° C. There is preferably also employed a second-step tempering heat treatment at a temperature range of preferably from 700° to 750° C. so that $M_{23}C_6$ type carbides and intermetallic compounds are precipitated mainly at grain boundaries and martensite lath boundaries while MX type carbonitrides can be precipitated within martensite laths. If the first-step tempering heat treatment temperature is lower than 650° C., the untransformed austenite may not be capable of completely acting as martensite laths, and if higher than 730° C., the effect of the second-step tempering heat treatment may not be obtained satisfactorily. Thus, the first-step tempering temperature is determined to preferably be within the range of 650° to 730° C.

Further, if the second-step tempering heat treatment temperature is lower than 700° C., the precipitation of the aforesaid $M_{23}C_6$ type carbides and MX type cabonitrides may not be able to attain equilibrium satisfactorily, resulting in a relative reduction in the volume fraction of the precipitates. Moreover, when these precipitates in such an unstable state are subsequently subjected to creep at high temperatures above about 600° C. for a long period of time, the precipitation may proceed further and the aggregation and coarsening of the precipitates may become excessive. On the other hand, if the second-step tempering heat treatment temperature exceeds about 750° C., approaching the transformation point to $A_{c1}$ (=about 780° C.) to austenite, the density of the MX type carbonitrides precipitated within martensite laths may be reduced and the tempering may becomes excessive. Accordingly, it is preferable that the second-step tempering heat treatment temperature be within the range of 700° to 750° C.

Next, there will be explained a suitable method for producing the heat-resistant steels according to the present invention. These heat-resistant steels of the present invention are characterized in that they may be produced by means a conventional melting and ladle-refining method. In large-sized cast steel products such as represented by steam turbine casings, there tends to occur segregation of added elements and ununiformities in the solidified structure, as well as porosities therein due to gaseous components. In case of the heat-resistant cast steels according to the present invention, it is desirable to employ a production method particularly capable of restricting such occurrence of porosities due to gaseous components while reducing the same as less as possible, in the large-sized cast steels. Thus, it is preferable to employ the ladle- refining method as a refining method outside a furnace after melting, thus the occurrence of porosities due to gaseous components be generally be reduced and the reliability and uniformity of the large-sized steel ingots be improved.

The above and further objects, features, details and advantages of the present invention will become apparent from the following detailed description of the preferred embodiments of the invention, when read in conjunction with the accompanying drawings.

EXAMPLES

Example 1

With reference to Table 1, there are shown chemical compositions of the eight kinds of heat-resistant cast steels used as test specimens, in which Nos. 1 to 6 of steels are included within the chemical composition range of heat-resistant cast steels according to the present invention, while Nos. 7 and 8 of steels are comparative steels outside the composition range of Nos. 1 to 6 of steels. These heat-resistant cast steels were first melted in a vacuum melting furnace of a laboratory-scale, to obtain ingots each weighing 50 kg. These ingots were then subjected to pre-heat treatment (e.g., air cooling at 1,100° C. and 700° C.) under conditions simulating actual casing members, and thereafter to a heat-treatment which simulates the cooling rate for quenching for thick parts of a large-sized steam turbine casing. Particularly, in the latter treatment, the ingots were heated for 10 hours at 1,030° C. to be completely austenitized, and then quenched while maintaining the quenching rate of the thick part at a cooling rate of 5° C./min., followed by a first-step tempering for 10 hours at 700° C. and a second-step tempering for 10 hours at 700° to 720° C. subsequent thereto. The tempering treatment conditions were controlled so that the strength required for designing casing members (i.e., 0.2% yield strength at room temperature) has a value of 56 kg/mm or greater.

As to the steels Nos. 1 to 6 of the present invention and comparative Nos. 7 and 8, tensile tests and impact tests were performed, both at room temperature (20° C.), and the impact tests were also performed over the temperature range of −20° to 100° C. at intervals of 20° C. Based on the obtained Charpy impact test results, impact values and 50% FATT values were estimated and shown in Table 2 together with tensile properties. The steels Nos. 1 to 6 and 7 and 8 were also subjected to creep rupture tests at both temperatures of 600° C. and 650° C. Although omitted in Table 2, the creep rupture elongation were 30 to 40% and rupture reduction of area were 80 to 90%, respectively, while the creep rupture ductilities were excellent for strengthening of notching.

Further, estimated by extrapolation were the creep rupture strength at 600° C. and 650° C. each for $10^5$ hours, based on the test results. The results and estimations are shown in Table 2. As apparent therefrom, any of the steels of the present invention have such strength levels of more than or equal to 60 kg/mm$^2$ of 0.2% yield strength, which are satisfactory for casing members of steam turbines. In addition, their resultant elongations and reductions of area fully satisfy the elongation of greater than or equal to 18% and reduction of area greater than or equal to 40% as required for general casing members. Concerning impact properties, while the desired value of 50% FATT is +100° C. or less as to casing members of steam turbines, each of the present steels Nos. 1 to 6 and the comparative steels Nos. 7 and 8 has a value not more than the desired, so that satisfactory toughness is attributed to each of them.

From Table 2 is seen that the 105 hour creep rupture strength at 650° C. of each of the present steels Nos. 1 to 6 is as great as 1.05 to 1.25 times or more that of each of comparative steels Nos. 7 and 8, so that the present steels have improved creep rupture strength leading to especially extended creep rupture life. Although the comparative Nos. 7 and 8 have tensile strength and toughness satisfactory for the desired values, they have creep rupture strength inferior to the present steels Nos. 1 to 6. It goes without saying that comparative steels Nos. 7 and 8 have δ-ferrite produced during preparation of ingots in some amount which is undesirable for casing members.

Example 2

In the Example 2, an alloy (test steel weighing as heavy as 1 ton) having the composition No. 4 in Table 1 for the Example 1 was melted in an electric furnace, and then the impurities in the melt was reduced by means of outside furnace refining, followed by casting into a sand-mold. The shape of casting is shown in FIG. 1, where reference numeral 1 designates a thick part of the casting just under the riser while numeral 2 designates a thin part as bottom side. The specimen tested in the Example 2 was prepared by treating the thus cast steel ingot weighing 1 ton by the heat treatments (quenching and tempering) in the same manner with the Example 1. For evaluation of mechanical properties of the specimen, test pieces were cut out from the thick part 1 and thin part 2 of the specimen, respectively, and then tested. Although omitted in Table 3, the creep rupture elongation were 30 to 40% and the rupture reduction of area of the Example 2 were 80 to 90%, respectively, similar to the small-sized melts or specimens of Example 1, so that the creep rupture ductility was excellent for strengthening of notching also in the Example 2. Shown in Table 3 are test results derived from the ingot weighing 1 ton, which are arranged in the same manner with the small-sized melts of specimens of Example 1. As apparent from Table 3, the test specimen of Example 2 has excellent values in both of high-temperature creep strength and elongation toughness.

Example 3

In this Example 3, there is explained a metallographic structure thereof, particularly, types and amounts of the precipitates. In FIG. 2, there is exemplarily shown a typical 100% tempered martensite structure (i.e., complete martensite structure) in the observation results of the metallographic structures on replicas extracted from the specimens in the steels of the Example 1 according to the present invention. As seen from this figure, the 100% tempered martensite structure consists of grain boundary 3 (former austenite grain boundary), martensite laths boundary 4, and the inner part of martensite laths 5. In this figure, the types of precipitates are shown in a manner divided into as-tempered samples and those having been subjected to creep rupture, but no particular differences can be seen therebetween about the types of precipitates. First of all, agglomerated $M_{23}C_6$ type carbides and granular intermetallic compounds (Laves phases) are precipitated at the grain boundaries 3. From the viewpoint of composition, the $M_{23}C_6$ type carbides are compounds of carbon and M elements such as Fe, Cr, Mo and W, while the intermetallic compounds (Laves phases) are of the $Fe_2M$ type in which the M element is Cr, Mo, W or the like. Also precipitated at the martensite lath boundaries 4 are the above-described $M_{23}C_6$ type carbides and intermetallic compounds (Laves phases). Moreover, fine MX type carbonitrides are precipitated in the inner part of the martensite laths 5. From the viewpoint of composition, the MX type carbonitrides are fine carbonitrides formed by combination of Nb and V as M elements with C and N as X elements. The metallographic structures of sample Nos. 1 to 6 shown in Example 1 and that in Example 2 are consisted of a 100% tempered martensite structure in all cases.

The priority document Japanese Patent Application No. 239022/1996 filed Sep. 10, 1996, including the title, specification, figures, abstract and claims is incorporated herein by reference in its entirety.

Although what have been described are at present considered to be the preferred embodiments of the invention, it will be understood that the present invention may be embodied in other specific forms without departing from the spirit or essential characteristics thereof. The present embodiments are therefore to be considered in all respects as illustrative and not restrictive. The scope of the invention is indicated by the appended claims rather than by the foregoing description.

TABLE 1

(Numerical values designate weight percentages.)

| Sample No. | Chemical Composition | | | | | | | | | | | | | | |
|---|---|---|---|---|---|---|---|---|---|---|---|---|---|---|---|
| | C | Si | Mn | P | S | Ni | Cr | Mo | W | V | Nb | N | B | Co | Fe |
| Inventive Steels | | | | | | | | | | | | | | | |
| 1 | 0.10 | 0.20 | 0.30 | 0.013 | 0.002 | 0.50 | 10.0 | 0.40 | 1.80 | 0.15 | 0.057 | 0.031 | 0.003 | 3.5 | Balance |
| 2 | 0.11 | 0.20 | 0.30 | 0.013 | 0.002 | 0.50 | 9.7 | 0.60 | 1.82 | 0.14 | 0.053 | 0.030 | 0.003 | 3.6 | Balance |
| 3 | 0.10 | 0.20 | 0.30 | 0.013 | 0.002 | 0.50 | 9.9 | 0.40 | 1.85 | 0.15 | 0.042 | 0.027 | 0.003 | 3.5 | Balance |
| 4 | 0.10 | 0.20 | 0.30 | 0.013 | 0.002 | 0.50 | 9.6 | 0.60 | 1.84 | 0.14 | 0.043 | 0.026 | 0.003 | 3.6 | Balance |
| 5 | 0.10 | 0.20 | 0.30 | 0.013 | 0.002 | 0.50 | 10.0 | 0.45 | 1.80 | 0.15 | 0.045 | 0.028 | 0.002 | 3.0 | Balance |
| 6 | 0.10 | 0.20 | 0.30 | 0.013 | 0.002 | 0.50 | 9.9 | 0.55 | 1.82 | 0.15 | 0.046 | 0.027 | 0.001 | 2.5 | Balance |
| Comparative Steels | | | | | | | | | | | | | | | |
| 7 | 0.09 | 0.18 | 0.57 | 0.010 | 0.002 | 0.50 | 11.57 | 0.40 | 1.82 | 0.14 | 0.050 | 0.058 | — | 1.9 | Balance |
| 8 | 0.09 | 0.17 | 0.56 | 0.010 | 0.001 | 0.47 | 9.4 | 0.42 | 1.81 | 0.14 | 0.060 | 0.066 | — | 1.0 | Balance |

| Sample No. | Mo equivalent, formula (1) | Cr equivalent, formula (2) | B equivalent, formula (3) | Nb equivalent, formula (4) |
|---|---|---|---|---|
| Inventive Steels | | | | |
| 1 | 1.30 | 2.9 | 0.018 | 0.097 |
| 2 | 1.51 | 2.7 | 0.018 | 0.097 |
| 3 | 1.32 | 2.9 | 0.016 | 0.082 |
| 4 | 1.52 | 3.1 | 0.016 | 0.083 |
| 5 | 1.35 | 4.1 | 0.016 | 0.085 |
| 6 | 1.46 | 5.5 | 0.014 | 0.086 |
| Comparative Steels | | | | |
| 7 | 1.31 | 6.4 | 0.029 | 0.086 |
| 8 | 1.32 | 6.2 | 0.030 | 0.096 |

Notes:

Formula (1): Mo equivalent =0 Mo + 0.5W (A value of 1 to 2% is claimed in the present invention.)

Formula (2): Cr equivalent = Cr + 6Si + 4Mo + 1.5W + 11V + 5Nb − 40C − 2Mn − 4Ni − 2Co − 30N (A value of 6.5% or less is claimed in the present invention.)

Formula (3): B equivalent: = B + 0.5N (A value of 0.030% or less is claimed in the present invention.)

Formula (4): Nb equivalent: = Nb + 0.4C (A value of 0.12% or less is claimed in the present invention.)

TABLE 2

| Sample No. | Properties: Tensile Strength (kgf/mm²) | 0.2% Yield Strength (kgf/mm²) | Elongation (%) | Reduction of Area (%) | Impact Value (at 20° C.) (kgf-m/cm²) | 50% FATT (°C.) | $10^5$ hr creep Rupture Strength (kgf/mm²) 600° C. | 650° C. | Amount of δ-ferrite (%) |
|---|---|---|---|---|---|---|---|---|---|
| Inventive Steels | | | | | | | | | |
| 1 | 80.7 | 66.1 | 23.6 | 58.7 | 13.1 | 0 | 14.8 | 10.0 | 0 |
| 2 | 79.7 | 65.8 | 24.8 | 65.7 | 6.8 | 20 | 13.3 | 9.2 | 0 |
| 3 | 83.2 | 70.2 | 23.2 | 63.1 | 5.0 | 25 | 14.5 | 10.1 | 0 |
| 4 | 81.6 | 68.9 | 22.0 | 62.3 | 5.1 | 24 | 15.2 | 10.5 | 0 |
| 5 | 83.3 | 70.2 | 23.6 | 64.0 | 8.4 | 26 | 15.0 | 9.8 | 0 |
| 6 | 81.1 | 68.5 | 21.2 | 60.5 | 7.0 | 27 | 15.5 | 10.8 | 0 |
| Comparative Steels | | | | | | | | | |
| 7 | 78.8 | 63.5 | 20.5 | 62.3 | 10.5 | 7 | 10.8 | 8.7 | 1.3 |
| 8 | 81.2 | 65.7 | 23.2 | 62.4 | 4.8 | 35 | 11.5 | 8.5 | 0.4 |

TABLE 3

| Sample No. | Properties: Tensile Strength (kgf/mm²) | 0.2% Yield Strength (kgf/mm²) | Elongation (%) | Reduction of Area (%) | Impact Value (at 20° C.) (kgf-m/cm²) | 50% FATT (°C.) | $10^5$ hr creep Rupture Strength (kgf/mm²) 600° C. | 650° C. | Amount of δ-ferrite (%) |
|---|---|---|---|---|---|---|---|---|---|
| Thick | 81.0 | 68.5 | 22.0 | 60.5 | 5.1 | 24 | 15.5 | 10.2 | 0 |
| Part | 81.1 | 68.9 | 21.2 | 60.5 | 7.0 | 20 | | | |
| Thin | 83.3 | 70.2 | 23.6 | 64.0 | 8.4 | 18 | 15.0 | 10.4 | 0 |
| Part | 83.2 | 70.2 | 23.2 | 63.1 | 5.0 | 15 | | | |

We claim:

1. A heat-resistant cast steel having a martensite matrix structure and consisting essentially of, based on weight percentage:

0.08 to 0.25% carbon;

more than 0.1% and up to 0.5% silicon;

not more than 1% manganese;

0.05 to 1% nickel;

9 to 12% chromium;

0.3 to 1.5% molybdenum;

1 to 1.95% tungsten;

0.1 to 0.35% vanadium;

0.02 to 0.1% niobium;

0.01 to 0.08% nitrogen;

0.001 to 0.01% boron;

2 to 8% cobalt; and the balance substantially iron.

2. A cast steel according to claim 1, wherein the Cr equivalent defined by (Cr+6Si+4Mo+1.5W+11V+5Nb−40C−2Mn−4Ni−2Co−30N) is 6.5% or less;

the B equivalent defined by (B+0.5N) is 0.33% or less;

the Nb equivalent defined by (Nb+0.4C) is 0.12% or less;

the Mo equivalent defined by (Mo+0.5W) is 1 to 2%; and among unavoidable impurity elements, sulfur is 0.01% or less, phosphorus is 0.03% or less, and copper is 0.5% or less.

3. A cast steel as claimed in claim 1 or 2, wherein said cast steel is treated by:

subjecting said steel to a solution and quenching heat treatment at a temperature in the range of 1,000° to 1,150° C. subjecting said steel to a first-step of tempering at a temperature of at least 650° to 730° C. after quenching, and subjecting said steel to a second-step of tempering at a temperature of 700° to 750° C. which acts as an annealing step for stress removal.

4. A cast steel as claimed claim 3, wherein $M_{23}C_6$ carbides and intermetallic compounds are precipitated mainly at grain boundaries and martensite lath boundaries of said steel, and MX type carbonitrides are precipitated internally of martensite laths of said steel, so that the steel contains precipitates.

5. A cast steel as claimed in claim 4, wherein said steel is produced by a melting and ladle-refining method.

6. A cast steel according to claim 1, wherein carbon is present in an amount from 0.09 to 0.13%.

7. A cast steel according to claim 1, wherein manganese is present in an amount from 0.2 to 0.5%.

8. A cast steel according to claim 1, wherein nickel is present in an amount from 0.05 to 0.5%.

9. A cast steel according to claim 1, wherein chromium is present in an amount from 9.5 to 10.5%.

10. A cast steel according to claim 1, wherein vanadium is present in an amount from 0.15 to 0.25%.

11. A cast steel according to claim 1, wherein niobium is present in an amount from 0.02 to 0.05%.

12. A cast steel according to claim 1, wherein boron is present in an amount from 0.003 to 0.008%.

13. A cast steel according to claim 1, wherein nitrogen is present in an amount from 0.02 to 0.04%.

14. A cast steel according to claim 1, wherein cobalt is present in an amount from 3 to 4%.

15. A cast steel steam turbine casing, precision cast vane or valve cast from a cast steel according to claim 1.

* * * * *

US005798082B1

REEXAMINATION CERTIFICATE (4048th)

United States Patent [19] [11] B1 5,798,082

Kadoya et al. [45] Certificate Issued Apr. 18, 2000

[54] HIGH-STRENGTH AND HIGH-TOUGHNESS HEAT-RESISTANT CAST STEEL

[75] Inventors: Yoshikuni Kadoya; Hisataka Kawai; Ryotarou Magoshi, all of Hyogo-ken, Japan

[73] Assignee: Mitsubishi Heavy Industries, Ltd., Tokyo, Japan

Reexamination Request:
No. 90/005,463, Aug. 25, 1999

Reexamination Certificate for:

| | |
|---|---|
| Patent No.: | **5,798,082** |
| Issued: | **Aug. 25, 1998** |
| Appl. No.: | **08/846,171** |
| Filed: | **Apr. 28, 1997** |

[30] Foreign Application Priority Data

Sep. 10, 1996 [JP] Japan ..... 8-239022

[51] Int. Cl.[7] ..... C22C 38/44; C22C 38/46

[52] U.S. Cl. ..... 420/38; 148/325; 148/326

[58] Field of Search ..... 420/38; 148/325, 148/326

[56] References Cited

FOREIGN PATENT DOCUMENTS

| | | |
|---|---|---|
| 2142924 | 8/1995 | Canada . |
| 767 250 | 4/1997 | European Pat. Off. . |
| 4-371552 | 12/1992 | Japan . |
| 7-26329 | 1/1995 | Japan . |
| 7-216513 | 8/1995 | Japan . |
| 7-286247 | 10/1995 | Japan . |
| 8-120414 | 5/1996 | Japan . |

*Primary Examiner*—Deborah Yee

[57] ABSTRACT

There are provided high-strength and high-toughness heat-resistant cast steels applicable to steam turbine casings, precision cast vanes and valves. There is disclosed a high-strength and high-toughness heat-resistant cast steel formed of a heat-resistant cast steel consisting of, based on weight percentage: 0.08 to 0.25% of carbon; more than 0.1 not more than 0.5% of silicon; 1% or less of manganese; 0.05 to 1% of nickel; 9 to 12% of chromium; 0.3 to 1.5% of molybdenum; 1 to 1.95% of tungsten; 0.1 to 0.35% of vanadium; 0.02 to 0.1% of niobium; 0.01 to 0.08% of nitrogen; 0.001 to 0.01% of boron; and 2 to 8% of cobalt; the balance substantially being iron; and having a martensite matrix structure.

TYPE OF WHOLE METALLOGRAPHIC STRUCTURE:

TEMPERED MARTENSITE STRUCTURE

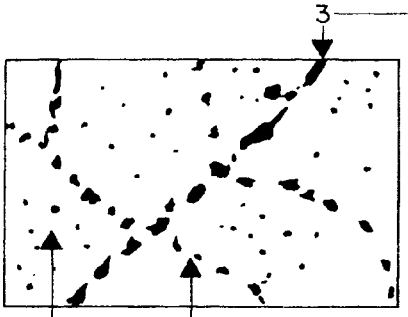

| POSITION / DIVISION | INTERIOR OF MARTENSITE LATHS | MARTENSITE LATH BOUNDARY | GRAIN BOUNDARY (FORMER AUSTENITE GRAIN BOUNDARY) |
|---|---|---|---|
| FORMS OF PRECIPITATES | FINE PRECIPITATES | AGGLOMERATED GRANULAR PRECIPITATES | AGGLOMERATED GRANULAR PRECIPITATES |
| AS-TEMPERED STATE AFTER HEAT-TREATMENT | •MX TYPE CARBONITRIDES | •$M_{23}C_6$ TYPE CARBIDES •INTERMETALLIC COMPOUNDS (LAVES PHASES) | •$M_{23}C_6$ TYPE CARBIDES •INTERMETALLIC COMPOUNDS (LAVES PHASES) |
| AFTER CREEP RUPTURE | •MX TYPE CARBONITRIDES | •$M_{23}C_6$ TYPE CARBIDES •INTERMETALLIC COMPOUNDS (LAVES PHASES) | •$M_{23}C_6$ TYPE CARBIDES •INTERMETALLIC COMPOUNDS (LAVES PHASES) |

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *